United States Patent [19]

Beistegui Chirapozu

[11] Patent Number: 4,548,406

[45] Date of Patent: Oct. 22, 1985

[54] GYMNASTIC BICYCLE

[75] Inventor: Jose L. Beistegui Chirapozu, Vitoria, Spain

[73] Assignee: B.H. S.A., Madrid, Spain

[21] Appl. No.: 520,449

[22] Filed: Aug. 2, 1983

[30] Foreign Application Priority Data

Aug. 6, 1982 [ES] Spain ..... 266.835
Aug. 6, 1982 [ES] Spain ..... 266.836

[51] Int. Cl.[4] ..... A63B 69/16
[52] U.S. Cl. ..... 272/73; 272/132
[58] Field of Search ..... 272/73, 132, 128, 116, 272/131; 128/25 R

[56] References Cited

U.S. PATENT DOCUMENTS 3,024,023 3/1962 Steller ..... 272/132 X
3,511,500 5/1970 Dunn ..... 272/132 X

*Primary Examiner*—Richard J. Apley
*Assistant Examiner*—Kathleen D'Arrigo
*Attorney, Agent, or Firm*—Wenderoth, Lind & Ponack

[57] ABSTRACT

A gymnastic bicycle includes a device for regulating the physical effort necessary for tilting handlebars with respect to a chassis during exercises simulating rowing, together with a vibrator formed by a lever having one end permanently connected to the articulation of the handlebar tube with respect to the chassis. The other end of the lever has a roller capable of contacting a polygonal surface which rotates as a result of pedalling. The polygonal surface forms part of or is closely linked to an inertia flywheel which constitutes a power accumulator and pedalling regulator. Contact or separated positions of the roller with respect to the polygonal surface are obtained by a control knob fixed to a shaft provided at its free end with two axially spaced surfaces which, on rotation of the knob and shaft, alternately contact a plate, thereby pivoting the lever with respect to the chassis of the bicycle.

9 Claims, 5 Drawing Figures

GYMNASTIC BICYCLE

BACKGROUND AND SUMMARY OF THE INVENTION

The present invention relates to a gymnastic bicycle including a device to transmit vibrations generated by the effect of pedaling to the body of the user and a mechanism for regulating the physical effort necessary for practicing the exercise of rowing.

As is known in a gymnastic or static bicycle, apart from the conventional pedaling exercise similar to that of a conventional movable bicycle, there is the possibility of practicing the exercise of rowing through the alternating oscillation of the handlebars, and also of supplying a vibratory movement to the body of the user, at certain positions of the bicycle elements and when pedaling.

According to the invention, the vibrator mechanism includes a lever having one end connected permanently to a hub which defines an articulation between the bottom end of a tube or stem of the handlebars and the chassis or static structure of the bicycle, such hub thus allowing a rowing exercise. The other end of the lever is provided with a roller adapted to contact a rotating polygonal surface, which rotation is achieved by pedaling of the bicycle. When the roller is in contact with the polygonal surface, a reciprocal pivoting movement is imparted to the lever, and this is converted into a vibration transmitted to the handlebars and from here to the body of the user.

According to the invention, the polygonal surface against which the lever roller makes contact forms part or is closely linked to an inertia flywheel which forms a power regulator accumulator for pedaling and contact and/or separation of the roller with respect to the polygonal surface is achieved by regulating the position of a control knob and thereby a rod or shank having at a free end thereof two axially spaced abutting surfaces for contacting a plate fixed to the end of the lever adjacent the hub. Such two abutting surfaces define two positions for the lever, one with the roller abutting the polygonal surface and the other with the roller spaced therefrom.

Thus, there is formed a vibrator for a gymnastic bicycle having the advantages inherent in an inertia flywheel with which this type of bicycle is equipped, compared with a conventional vibrator wherein the polygonal surface is made on a gooseneck linked to the pedaling axis of the bicycle.

In accordance with a preferred embodiment, the polygonal surface against which the lever roller makes contact is located in an internal periphery of a rim of the inertia flywheel.

In a second embodiment, the polygonal surface is formed on a body or pin linked to the inertia flywheel shaft.

As mentioned hereinabove, the invention provides a device for regulating the physical effort required to perform a rowing exercise. Such regulating device includes a hub defining two internal equal frusto-conical surfaces having confronting smaller bases. Such frusto-conical surfaces are contacted by complementary shaped outer surfaces of respective bodies. Each body has a castellated end section keyed to the bicycle chassis, thereby allowing axial displacement of the bodies relative to the hub to thus regulate the degree of effort required to rotate the hub. The hub is fixed to the lower end of the tube or stem of the handlebars, such that the handlebar assembly can pivot within the longitudinal plane of the bicycle, through the physical effort of the user on pulling the handlebars towards him.

The bodies are connected to each other by means of a bolt which extends axially through the bodies, the bolt being provided at one of its ends with a hand-driven knob which has a bushing extending into an axial recess in the outer end of the respective body. The other body has formed in the outer end thereof a recess having a polygonal section and receiving a correspondingly shaped nut into which is threaded the other end of the bolt. Rotation of the bolt by the knob makes the two bodies move together or apart, and in this way it is possible to regulate the effort necessary to rotate the hub relative to the bodies.

The polygonal recess which holds the tightening nut is deeper than the thickness of the nut, and an expansion spring is interposed between the nut and the bottom of the recess, thus urging the respective body away from the nut and against the respective frusto-conical surface of the hub. Adjacent smaller ends of both bodies have respective recesses receiving another expansion spring tending to separate the bodies.

The regulator device of the invention is simplified considerably, both from the structural point of view and from the functional viewpoint, compared with conventional devices of this type. Thus, in accordance with conventional engineering regulation of this type is achieved by the use of a pinion joined to the middle area of a bolt joining two frusto-conical bodies. Such pinion cooperates with a pawl provided radially on the hub and retractable against the tension of a spring. A manual control knob is provided radially and externally of the hub.

In accordance with the invention, the internal pinion, the spring and the external radial control knob are eliminated, thus providing a more economical device and one with which the risks of failure of complex elements is avoided.

BRIEF DESCRIPTION OF THE DRAWINGS

Other objects, features and advantages of the invention will be apparent from the following description, with reference to the accompanying drawings, wherein.

DETAILED DESCRIPTION OF THE INVENION

Figure 1:
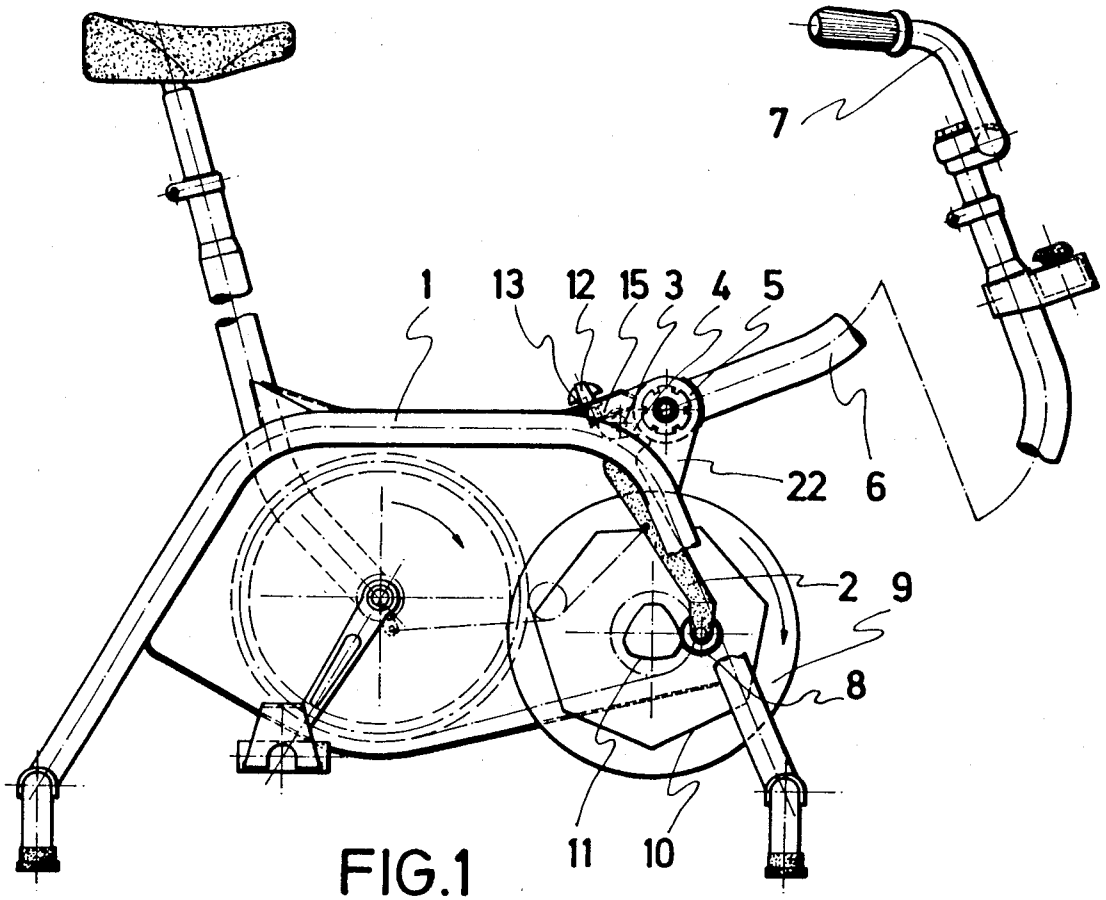
FIG. 1 is a schematic side elevation of a gymnastic bicycle according to the present invention, particularly illustrating a vibrating device basically thereof.
Figure 2:
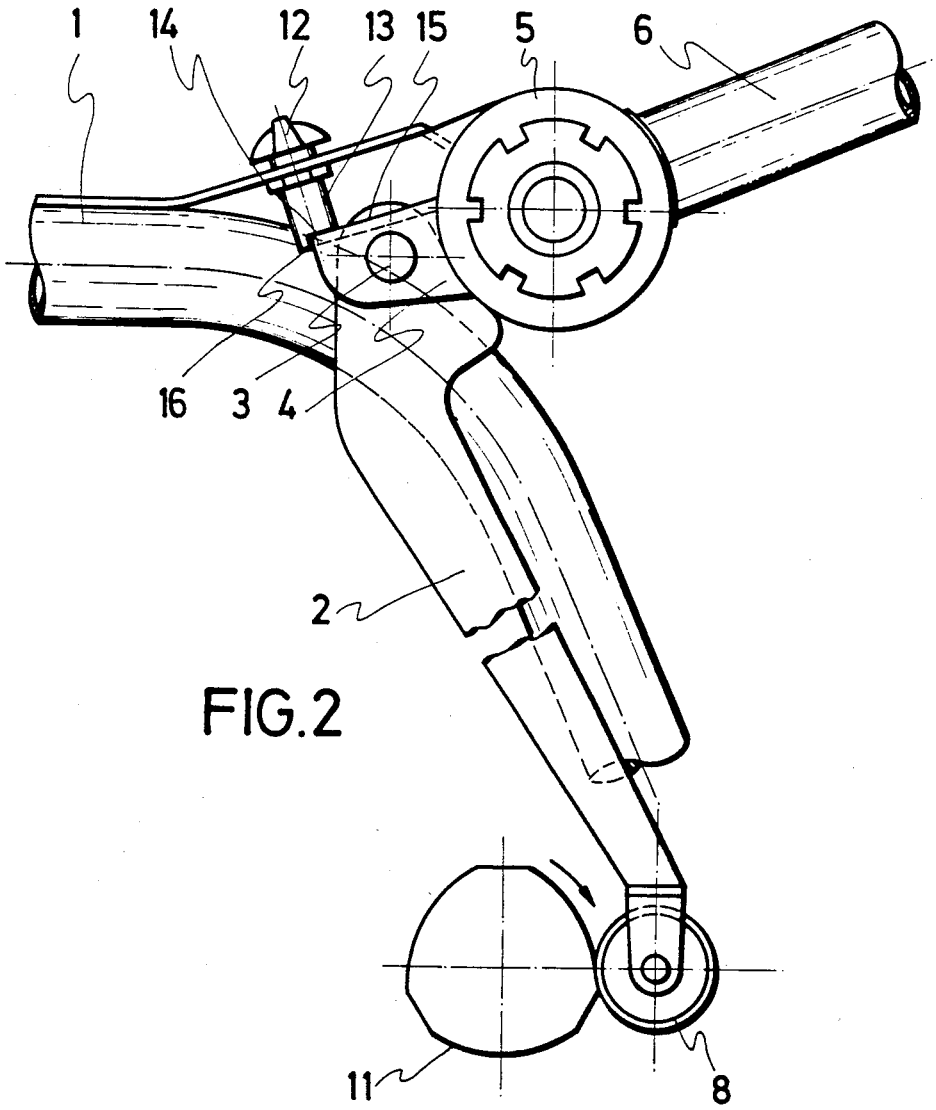
FIG. 2 is an enlarged detailed view of the vibrating device thereof, shown in the operating or working position thereof.
Figure 3:
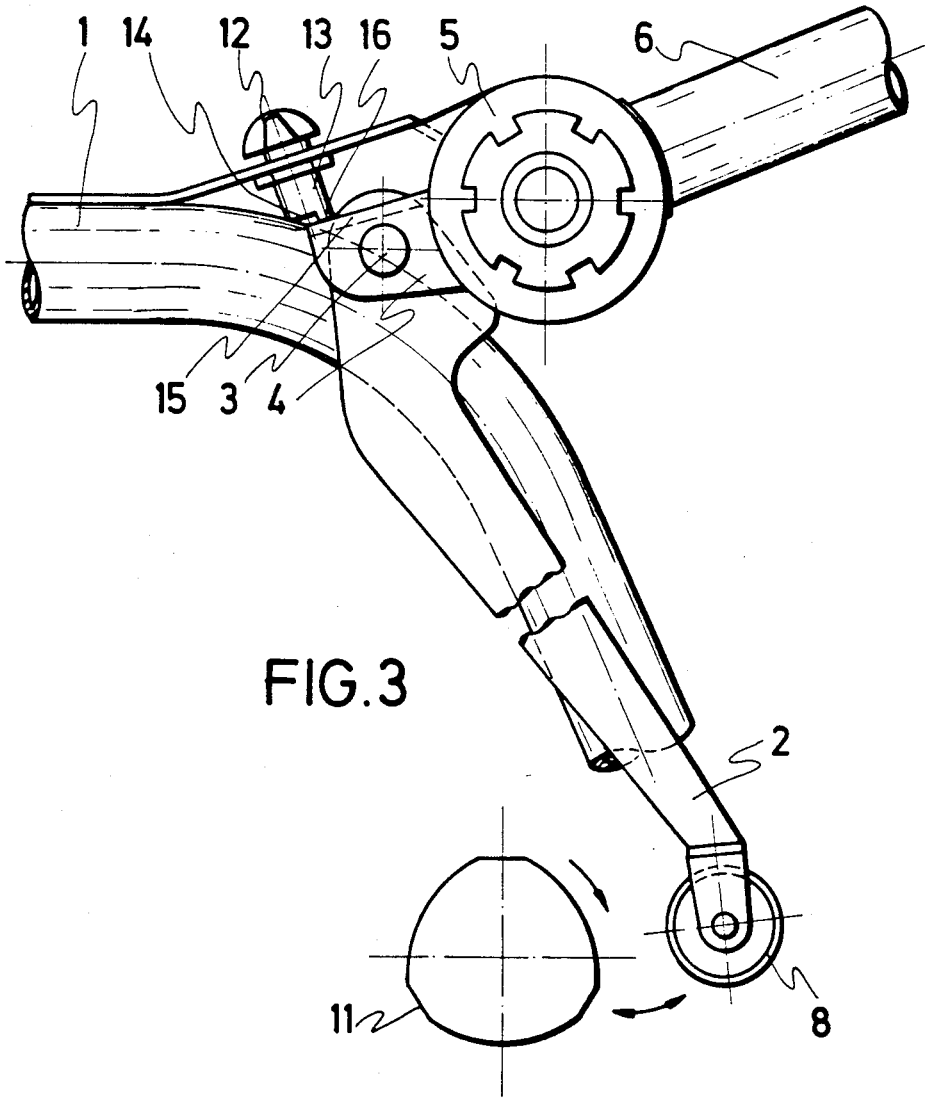
FIG. 3 is a view similar to FIG. 2, but showing the vibrating device in the idle position thereof.

As shown particularly in FIGS. 1 to 3, a gymnastic bicycle includes a vibrator formed by a lever 2 having one end articulated by an axle 3 to a pair of lugs 4 which extend radially from a hub 5. The bottom end of a stem 6 of handlebars 7 is fixed to hub 5. Hub 5 also formed a point of articulation of handlebars 7 with respect to fixed frame or chassis 1 of the bicycle during a rowing exercise therewith.

To the opposite end of lever 2 is mounted a roller 8 to make contact with or to be spaced from a polygonal surface. Such surface can be an internal peripheral surface 10 of an inertia flywheel 9 provided on the bicycle. Alternately, such surface can be a peripheral surface 11 of a trunnion or pin of the shaft of the inertia flywheel 9.

The lever 2, at its end hinged to the lugs 4, rests permanently on the periphery of the hub 5. The roller 8, at the other end of the lever 2, is adapted to make contact with or to be spaced from the polygonal surface 10 or 11.

Such contacting or spaced position of the roller 8 with respect to the polygonal surface 10 or 11 is achieved by rotation of a knob 12 and thereby a shank 13 which has at its free end two axially spaced abutting surfaces 14, 16 for alternately abutting, depending on the relative rotational position of shank 13 and knob 12, a plate 15 extending from the hub 5, plate 15 being located between the lugs 4.

The device operates as follows.

Assuming that the polygonal surface to be contacted by roller 8 to achieve vibration is surface 11, then when the user practices a pedaling exercise, the inertia flywheel 9 is rotated, with the consequent rotating displacement of the polygonal surface 11. This is transformed into a vibration of the lever 2, and such vibration is transmitted to the handlebars 7 and thus to the user's body.

During such operation, surface 14 contacts plate 15 by rotation of shank 13 and knob 12 to the position shown in FIG. 2.

When the vibrating effect is to be stopped, i.e. to perform the conventional pedaling exercise, the roller 8 is separated from the polygonal surface by rotating the knob 12 and the shank 13 to the position whosn in FIG. 3 such that surface 16 abuts the plate 15. To enable such rotation the handlebars 7 must previously be pulled backwards, i.e. counterclockwise as illustrated, whereby the hub 5 rotates slightly, thereby lowering the plate 15, and thus making it possible to turn the knob 12 so that the surface 16 is in a position to abut plate 15 when the handlebars are released. Thereby lever 2 is tilted such that roller 8 is prevented from contacting the polygonal surface.

As mentioned above, hub 5 includes a device for regulating resistance of the effort required for a rowing exercise.

Figure 4:
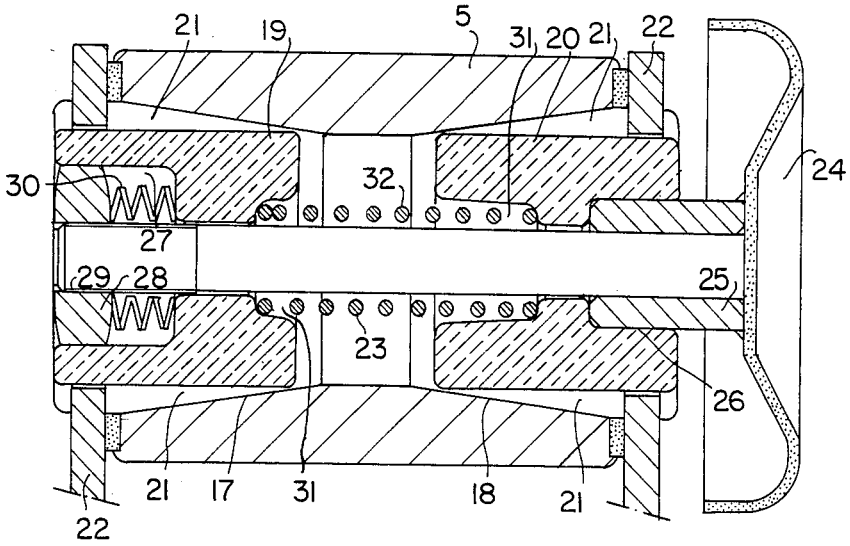
FIG. 4 is a diametrical cross-sectional view of a device for regulating the physical effort required for a rowing exercise.
Figure 5:
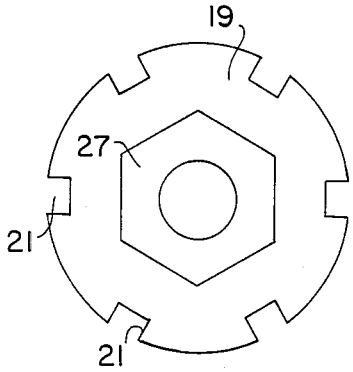
FIG. 5 is a front elevation view of a tightening device.

Such device, as shown in FIGS. 4 and 5, includes a pair of internal inwardly converging frusto-conical surfaces 17 and 18 formed on the interior of hub 5. Surfaces 17, 18 are complementary to the outer surfaces of a pair of bodies 19 and 20, respectively, which are at least partially castellated externally, e.g. by the provision of longitudinal slots 21 into which fit projections of respective brackets 22 which form an integral part of the chassis 1 of the bicycle, thereby preventing rotation of bodies 19, 20.

The bodies 19 and 20 are connected by means of a bolt or shank 23 which extends axially therethrough and which includes at one end an external axial knob 24 to adjust the device manually. Knob 24 is associated with a bushing or tubular element 25 which is partially housed in an end recess or mortise 26 in the body 20. Recess 26 is formed by the diametrical widening of the hole of the body through which extends the bolt 23, and the inner end of the bushing 25 abuts the step or bottom of the recess 26.

The other body 19 also has a recess or mortise 27 which has a polygonal cross-section complementary to the exterior of a nut 28 into which an end 29 of bolt 23 is threaded. The polygonal recess 27 is deeper than the width of the nut 28, in order to form a space between nut 28 and the bottom of the recess. A spring 30 is positioned in such space and acts as a resilient pressure member to urge the bodies 19, 20 toward each other.

With such structure, it will be apparent that the greater the pressure exerted by the bodies 19 and 20 against the respective complementary surfaces 17 and 18 of the hub 5, the more difficult it will be to rotate the hub and, consequently, the greater will be the effort required to tilt the handlebars during a rowing exercise.

The pressure of the bodies 19 and 20 against the respective complementary surfaces 17 and 18 of the hub 5 is regulated by rotating the knob 24 in one direction or the other, thus causing axial displacement in one direction or the other of the bodies. Consequently, the bodies are moved closer together or further apart, thereby exerting more or less pressure against the complementary respective surfaces of the hub 5.

Bodies 19 and 20 include, in the end thereof facing each other, respective axial recesses 31, in which extend the ends of an expansion spring 32 which acts to separate the bodies 19 and 20.

I claim:

1. An exercise device of the bicycle type, said device comprising:

a chassis adapted to be positioned stationarily;

a pedal assembly rotatably mounted on said chassis to enable a pedaling exercise by a user of the device;

an inertia flywheel rotatably mounted on said chassis by means separate from said pedal assembly, said inertia flywheel being rotatable in response to rotation of said pedal assembly, and said inertia flywheel having a polygonal surface;

a handlebar assembly;

means for mounting said handlebar assembly on said chassis for reciprocal pivotal movement relative thereto to enable a rowing execise by the user of the device;

means for, upon rotation of said pedal assembly during a pedaling exercise, generating and transmitting vibrations to said handlebar assembly and thus to the arms of the user, said vibration generating and transmitting means comprising a lever having a first end connected to said handlebar assembly and a roller supported on a second end of said lever and in contact with said polygonal surface, such that upon rotation of said inertia flywheel as a result of pedaling of said pedal assembly said polygonal surface imparts vibrations to said roller, and thereby to said lever and said handlebar assembly; and means for selectively interrupting generation and transmission of said vibrations, said interrupting means comprising a shaft rotatably mounted on said chassis, a manual control knob at a first end of said shaft for rotation of said shaft about the axis thereof, a second end of said shaft having first and second axially spaced abutting surfaces, and a plate fixed to said handlebar assembly to be abutted alternately by said first or second abutting surfaces, depending on the relative rotation position of said knob and said shaft, said handlebar assembly and said lever being pivotal about said mounting means between a first position when said first abutting surface abuts said plate, whereat said roller is in contact with said polygonal surface, and a second position when said second abutting surface abuts said plate, whereat said roller is spaced from said polygonal surface, thereby interrupting the generation of vibrations upon rotation of said inertia flywheel during a pedaling exercise.

2. A device as claimed in claim 1, wherein said inertia flywheel includes a rim, and said polygonal surface is at an internal periphery of said rim.

3. A device as claimed in claim 1, said polygonal surface is formed externally of a rotational shaft of said inertia flywheel.

4. A device as claimed in claim 1, wherein said mounting means includes means for selectively adjusting the physical effort required of the user during a rowing exercise to pivot said handlebar assembly with respect to said chassis.

5. A device as claimed in claim 4, wherein said handlebar assembly includes a stem having an integral hub, said first end of said lever is fixed to said hub externally thereof, and said adjusting means includes first and second frusto-conical interanl surfaces of said hub converging axially toward each other, first and second bodies extending into said hub and having respective frusto-conical external surfaces complementary to and in abutting contact with said first and second internal surfaces, respectively, means for supporting said bodies on said chassis to enable relative movement therebetween in directions axially of said bodies and to prevent relative movement therebetween in directions circumferentially of said bodies, and means for selectively moving said bodies in directions toward or away from each other and thereby for increasing or decreasing, respectively, the contact pressure between said external and internal surfaces.

6. A device as claimed in claim 5, wherein said supporting means comprises longitudinal slots formed in the exteriors of said bodies, and projections of said chassis extending into said slots, whereby said bodies are capable of axial movement toward or away from each other, but are prevented from circumferential movement due to engagement of said projections into said slots.

7. A device as claimed in claim 5, wherein said moving means comprises a bolt extending axially through said bodies, a manual adjusting knob fixed to a first end of said bolt, a circular external axial recess in said first body, a bushing fitting into said circular recess and abutting said recess to impart axial movement to said first body upon rotation of said adjusting knob and said shaft, a nut threaded onto a second end of said bolt and having a polygonal exterior, and a polygonal external axial recess in said second body, said nut fitting within said polygonal recess.

8. A device as claimed in claim 7, wherein said polygonal recess has an axial depth greater than the thickness of said nut, thus defining a space between said nut and the axial bottom of said polygonal recess, and further comprising first spring means in said space for urging said second body axially away from said nut.

9. A device as claimed in claim 8, further comprising internal axial recesses formed in confronting axial ends of said first and second bodies, and second spring means extending into said internal recesses for urging said bodies away from each other.

* * * * *